US007053558B2

(12) United States Patent
Hilbers et al.

(10) Patent No.: US 7,053,558 B2
(45) Date of Patent: May 30, 2006

(54) SYSTEM AND METHOD FOR CONTROLLING EMISSION BY A MICRO-FABRICATED CHARGE-EMISSION DEVICE

(75) Inventors: Richard Hilbers, Palo Alto, CA (US); Victor M. Aguero, Los Gatos, CA (US)

(73) Assignee: SRI International, Menlo Park, CA (US)

( * ) Notice: Subject to any disclaimer, the term of this patent is extended or adjusted under 35 U.S.C. 154(b) by 0 days.

(21) Appl. No.: 10/654,204

(22) Filed: Sep. 3, 2003

(65) Prior Publication Data

US 2005/0046358 A1 Mar. 3, 2005

(51) Int. Cl.
*G09G 3/10* (2006.01)

(52) U.S. Cl. ..... 315/169.1; 315/169.3; 345/74; 345/76

(58) Field of Classification Search ..... 315/169.3, 315/169.1; 345/74, 76
See application file for complete search history.

(56) References Cited

U.S. PATENT DOCUMENTS

| | | | | |
|---|---|---|---|---|
| 4,926,056 A | | 5/1990 | Spindt | |
| 5,223,226 A | | 6/1993 | Wittmer et al. | |
| 5,300,862 A | * | 4/1994 | Parker et al. | 315/169.1 |
| 5,331,159 A | | 7/1994 | Apffel, Jr. et al. | |
| 5,423,964 A | | 6/1995 | Smith et al. | |
| 5,486,337 A | | 1/1996 | Ohkawa | |
| 5,525,868 A | * | 6/1996 | Browning | 315/169.3 |
| 5,541,473 A | | 7/1996 | Duboc, Jr. et al. | |
| 5,578,906 A | * | 11/1996 | Smith | 315/169.3 |
| 5,872,010 A | | 2/1999 | Karger et al. | |
| 5,994,696 A | | 11/1999 | Tai et al. | |
| 6,043,487 A | | 3/2000 | Waki | |
| 6,114,693 A | | 9/2000 | Hirabayashi et al. | |
| 6,140,640 A | | 10/2000 | Wittmer et al. | |
| 6,245,227 B1 | | 6/2001 | Moon et al. | |
| 6,362,574 B1 | | 3/2002 | Aguero et al. | |
| 6,394,942 B1 | | 5/2002 | Moon et al. | |
| 6,454,938 B1 | | 9/2002 | Moon et al. | |
| 6,459,206 B1 | | 10/2002 | Aguero et al. | |
| 2003/0049177 A1 | | 3/2003 | Smith et al. | |

* cited by examiner

*Primary Examiner*—David Vu
(74) *Attorney, Agent, or Firm*—Guerin and Rodriguez LLP; Michael A. Rodriguez

(57) ABSTRACT

Described is a system and method of controlling charge emission by a micro-fabricated charge-emission device. The micro-fabricated charge-emission device has an emitter. A controllable current source is electrically connected to the emitter of the micro-fabricated charge-emission device by an electrical path. The controllable current source provides a controlled amount of electrical current to the emitter of the charge-emission device over the electrical path to induce the emitter to emit electrical charge. The system can include a current sink connected to the controllable current source for shunting at least a portion of the current to ground upon a detection of a particular charge emission condition.

35 Claims, 4 Drawing Sheets

(EMITTER CURRENT)

(EMITTER VOLTAGE)

(TOTAL GATE CURRENT)

SYSTEM AND METHOD FOR CONTROLLING EMISSION BY A MICRO-FABRICATED CHARGE-EMISSION DEVICE

FIELD OF THE INVENTION

The invention relates generally to micro-fabricated charge-emission devices. More particularly, the invention relates to systems and methods for controlling charge emission by a charge-emission device.

BACKGROUND

Research communities and microelectronics industries have for some time known about and used micro-fabricated charge-emission devices. Two types of charge-emission devices are field emission devices, which emit electrons, and field ionization devices, which emit ions. One class of charge-emission devices, referred to as a gated charge-emission device, has a gate electrode in close proximity to the tip of one or more emitters. In general, a voltage applied to the gate electrode relative to the tips of the emitters controls the quantity of charge emitted by the charge-emission device. Once the voltage exceeds a threshold, which can vary among the emitters, the charge-emission device begins to emit charge. A further increase in voltage induces a corresponding increase in the emitted charge. When the voltage falls below the threshold, the emitters cease to emit charge.

Because of the small scale of geometries of the gate electrode and emitters, micro-fabricated charge-emission devices require relatively low power to emit charge efficiently. Typically, the operating voltage for inducing charge emission from an emitter tip ranges between 50 and 100 volts. Consequently, micro-fabricated charge-emission devices are being used in a variety of applications, such as ion thrusters, micro-fluidic dispensers, and satellite charge controllers.

Notwithstanding their emission efficiency, charge-emission devices can be unstable as current sources. Fluctuations in the amount of emitted charge are highly dependent on the surface physics at each emitter tip and on the equilibrium of that emitter tip with its environment. Consequently, the amount of emitted charge can be difficult to control and susceptible to instabilities.

A typical technique to control charge emission is to construct a feedback system around the charge-emission device. In a typical feedback system, an adjustable voltage supply applies a voltage across the gate electrode and the emitters to induce the emitters to emit charge. A meter then measures the flow of charge through the device and, if the current measurement indicates that the flow of charge is not at a desired level, the applied voltage is adjusted accordingly. The process may repeat until the feedback system achieves the desired current emission level. Often the responsiveness of the feedback system is slow, inefficient, inaccurate, and susceptible to the variability of the emitters. Further, if the charge-emission device enters a runaway emission condition, the feedback system operates too slowly to avoid irreparable damage to the device.

Thus, there remains a need for a system and method for controlling charge emission by a charge-emission device that avoid the aforementioned disadvantages.

SUMMARY

In one aspect, the invention features a system comprising a micro-fabricated charge-emission device and a controllable current source. The charge-emission device has an emitter. The controllable current source is electrically connected to the emitter of the micro-fabricated charge-emission device by an electrical path. The controllable current source supplying to the emitter of the charge-emission device over the electrical path a controlled amount of electrical current that produces a potential difference at the emitter with respect to an electrode to induce the emitter to emit electrical charge.

In another aspect, the invention features a system comprising a micro-fabricated charge-emission device having an emitter and controllable means for supplying to the emitter of the charge-emission device a controlled amount of electrical current that produces a potential difference at the emitter with respect to an electrode to induce the emitter to emit electrical charge.

In another aspect, the invention features a method of controlling an amount of charge emitted by a charge-emission device. The method comprises supplying a controlled amount of current from a controllable current source to an emitter of a micro-fabricated charge-emission device and emitting charge from the emitter of the micro-fabricated charge-emission device in response to the current received from the controllable current source.

BRIEF DESCRIPTION OF THE DRAWINGS

The invention is pointed out with particularity in the appended claims. The advantages of the invention described above, as well as further advantages of this invention, may be better understood by reference to the following description taken in conjunction with the accompanying drawings, in which:

DETAILED DESCRIPTION

In brief overview, the present invention features systems and methods for controlling charge emission by a charge-emission device. As used herein, a charge-emission device is generally a device or structure with an emitter that emits charge (e.g., positive or negative ions and electrons) when subjected to a high electric field. Previous to the present invention, the charge-emission device performed the function of emitting charge and participated in the function of controlling the amount of charge emitted (i.e., output current) as part of a feedback loop. In the present invention, the function of emitting charge is separate from the function of controlling the amount of output current. More specifically, the charge-emission device performs the charge emission function, but does not control the amount of output current. A controllable current source, separate from the charge-emission device, directly controls the output current produced by that device. This separation of functions capitalizes on the efficiency of the charge-emission device to emit charge, while avoiding instabilities associated with using the charge-emission device to control the charge emission process.

Accordingly, the present invention achieves advantages such as the ability to control current independently of any feedback loop involving the charge-emission device and the ability to increase or decrease the output current more quickly than with a feedback loop. Further, the present invention enables direct control of the desired quantity of the output current and system behavior (i.e., current rise times and fall times), as described in more detail below.

Figure 1:
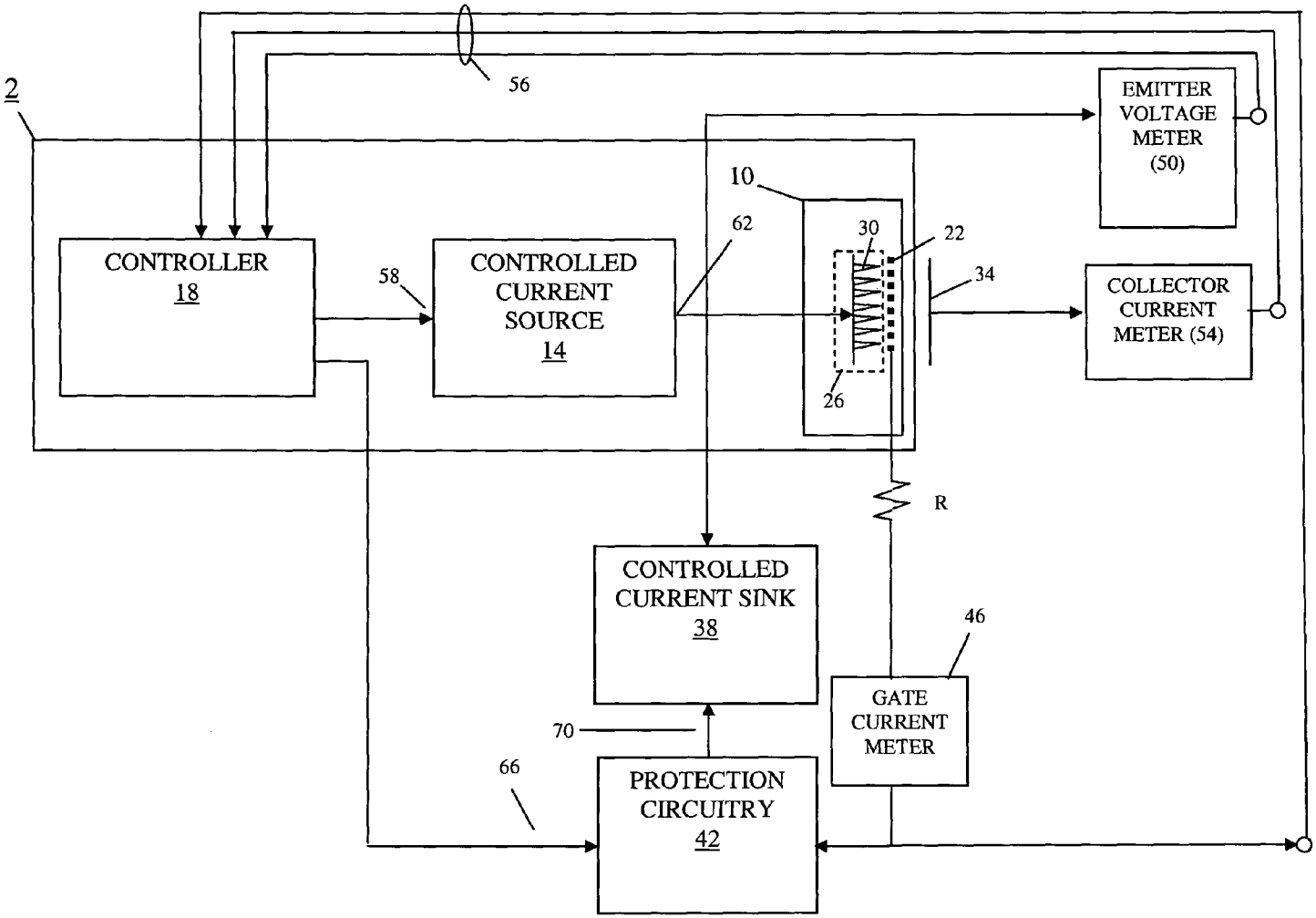
FIG. 1 is a block diagram of an embodiment of a system constructed in accordance with the invention for controlling emissions produced by a micro-fabricated charge-emission device.

FIG. 1 shows a controlled charge-emission system 2 embodying the invention. The controlled charge-emission system 2 can operate as a separate unit (e.g., a processor-based computerized system) or be incorporated within a larger system, such as a space-based application (e.g., a satellite). The charge-emission system 2 includes a gated charge-emission device 10, a controlled current source 14, and a current source controller 18. In one embodiment, the controlled current source 14 and charge-emission device 10 are integrated within a single component package. The system 2 includes a current collector 34, which can be a physical terminal or the environment in which the charge-emission device 10 is immersed. Optionally, the system 2 also includes a controlled current sink 38 and protection circuitry 42, either or both of which can be in the same or different component package as the controlled current source 14 and charge-emission device 10. Also optional, the system 2 includes a gate current meter 46 to measure the current flowing to the gate electrode 22, an emitter voltage meter 50 to measure the voltage on the array 26 of emitters 30, and a collector current meter 54 to measure current flowing from the charge-emission device 10 to the current collector 34. Measurements made by these meters 46, 50, and 54 pass to the controller 18 over signal paths 56, for analysis or recording by the controller 18.

The gated charge-emission device 10 is, in general, a micro-fabricated device having an integrated gate (or gate electrode) 22 and an array 26 of emitters 30. "Integrated" means that the gate electrode 22 is part of the micro-fabricated structure that includes the emitters 30, and "micro-fabricated" means that the devices are made by techniques for fabricating structures with features that are microscopic. Examples of such techniques include, but are not limited to, semiconductor processing (e.g., for integrated circuits), chemical vapor deposition (e.g., for carbon nanotubes), and liquid chemistry (e.g., for nano-scale colloidal particles). Examples of charge-emission devices are described in U.S. Pat. No. 3,789,471, issued to Spindt et al. on Feb. 5, 1974 and in U.S. Pat. No. 6,362,574, issued to Aguero et al. on Mar. 26, 2002, each of which patents is incorporated by reference herein in their entirety.

When there is sufficient voltage (e.g., typically 50v to 100v) between the gate electrode 22 and a given emitter 30, that emitter 30 emits electrons or ions or dispenses minute volumes of fluid, depending upon the particular application for which the charge-emission device 10 is being employed. Some gated charge-emission devices designed to emit electrons are referred to as field emission electron sources; some designed to emit ions are referred to as field ionization sources; and some designed to dispense fluids are referred to as micro-fluidic dispensers. To each of these types of charge-emission devices, to non-gated charge-emission devices (whether or not micro-fabricated), and to charge-emission devices (gated or non-gated) having a single emitter or an array of emitters, the principles of the invention apply. Examples of non-micro-fabricated, non-gated devices which can be used with the present invention are fine tungsten needles (coated with liquid metal to emit ions or liquid droplets and uncoated to emit electrons), and carbon nanotubes, either gated or non-gated, for emitting electrons.

In one embodiment, the gate electrode 22 is shared by all emitters 30 in the charge-emission device 10. In another embodiment, the gate electrode 22 is partitioned into a plurality of individually addressable gate electrodes. Each individually addressable gate electrode can activate one emitter or group of emitters (e.g., groups of ten, hundreds, thousands, and hundreds of thousands of emitters).

In general, the current source 14 is any device or circuit capable of supplying a controlled amount of electrical current. The current source 14 can be designed to supply electrons to the emitter array 26 and, thus, make the voltage potential at the emitters 30 more negative with respect to the gate electrode 22 or to draw electrons from the emitter array 26 and, thus, make the voltage potential at the emitters more positive with respect to the gate electrode 22. Whether supplying electrons to or drawing electrons from the emitter array 26, as used herein, the current source 14 is said to be supplying current to the emitter array 26.

The controlled current source 14 includes an input terminal 58 and an output terminal 62. The input terminal 58 is connected to the controller 18. The output terminal 62 is connected to the array 26 of emitters 30 of the charge emission device 10. In another embodiment, the system 2 includes a plurality of independently controlled current sources, each control source being connected to one emitter 30 only or to a group of emitters 30 (i.e., smaller than the full array 26).

The controller 18 is generally any system, device, or circuit adapted to communicate with the current source 14 to control the amount of electrical current supplied to the array 26 of emitters 30 by the current source 14. For embodiments having the current sink 38 and protection circuitry 42, the controller 18 is in communication with the protection circuitry 42 by signal path 66.

The controlled current sink 38, when present, is any system, device or circuit that is capable of shunting to common (or ground) some or all of the current being supplied by the current source 14 to the array 26 of emitters 30. The protection circuitry 42 is in communication with the controlled current sink 38 by signal path 70.

In general, the protection circuitry 42 is any system, device or circuit that is capable of monitoring the emission current or other characteristics of the charge-emission device 10, of detecting an unwanted characteristic of the emission current, gate current, or other signal, and of responding to the detection of the unwanted characteristic by issuing a signal over signal path 70 that activates the current sink 38. Because the gate current is a general indicator of the charge-emission operation of the gated emitters 30, monitoring the gate current of the gated charge-emission device 10 can provide an early indicator of malfunction on the part of the emitters 30. The protection circuitry 42 and current sink 38 cooperate to provide a responsive mechanism for rapidly preventing any potentially damaging effect on the charge-emission device 10 by the unwanted emission characteristic.

During operation of the system 2, the controller 18 sends to the current source 14 one or more signals that determine the amount of current to be supplied by the current source 14. In response to the signal or signals, the current source 14 supplies current to the array 26 of emitters 30 through the output terminal 62. The amount of current to be supplied depends upon the particular application of the charge emission system 2. For example, some space applications such as space propulsion can require hundreds of amperes, whereas other applications, such as space instruments, can require nanoamperes.

In one embodiment, the amount or level of current is predetermined. In another embodiment, the controller 18 determines the amount of current to be supplied by the current source 14 based on measurements by the gate current meter 46, by the emitter voltage meter 50, by the collector current meter 54, by any combination of the meters received over the signal paths 56, or by an external signal received at the controller 18 from outside the system 2. The signals sent by the controller 18 to the current source 14 also determine the rate at which the current reaches the desired level. For example, under program control the controller 18 can direct the current source 14 to increase the supplied current gradually to the desired level, e.g., linearly or stepwise, or to cycle the supplied current (e.g., on and off).

The system 2 self-regulates the emission of charge without the use of a feedback loop across the charge-emission device 10. Initially the emitters 30 are not emitting charge. While the current source 14 provides current to the array 26 of emitters 30, the magnitude of voltage on the emitters 30 with respect to the gate electrode 22 increases (i.e., if emitting electrons, the voltage at the emitters 30 becomes increasingly more negative with respect to the gate 22). Eventually, this voltage reaches sufficient magnitude (i.e., exceeds an emission threshold) to induce one or more emitters 30 to emit charge. If the emitters 30 emit charge faster than the current source 14 supplies charge, the amount of charge at the emitters 30 begins to deplete. This drop in the amount of charge drops causes a drop in voltage at the emitters 30. When the voltage drops below the emission threshold of the emitters 30, the emitters 30 turn off (i.e., cease to emit charge). Provided the current source 14 is still supplying current, charge resumes collecting at the emitters 30, and the process of inducing the emitters 30 to emit charge repeats.

During the process of controlling charge emission, each emitter 30 emits at its own efficiency. In the array 26 of emitters 30, each emitter 30 is subject to its own environmental conditions. Some environmental conditions, such as contamination at the emitter tip, can reduce the performance of the emitter 30. Each emitter 30 emits charge when the magnitude of the voltage at that emitter (with respect to the gate electrode 22) overcomes the environmental condition at that emitter tip. If the contamination is so severe as to render a particular emitter 30 inoperable, the increasing voltage at the array 26 (because of the continued supply of current) causes other operable emitters 30 to emit. Thus, the charge-emission device 10 with one or more functional emitters 30 is capable of emitting charge, although some emitters 30 may be inoperable.

While the current source 14 is supplying current to the array 26 of emitters 30, in one embodiment the protection circuitry 42 is monitoring the charge-emission device 10 for the occurrence of certain charge-emission conditions, such as excessive current and excessive rise time of the current. Such conditions are indicative of, for example, an improper electrical connection to the charge-emission device 10 (e.g., the output terminal 62 of the current source 14 is electrically connected to the gate electrode 22 through a short circuit from the array 26 of emitters 30). Upon detecting a particular charge emission condition, the protection circuitry 42 activates the current sink 38, which operates to shunt some or all the current provided by the current source 14 to ground and thus protect the charge-emission device 10 from irreparable damage.

Figure 2:
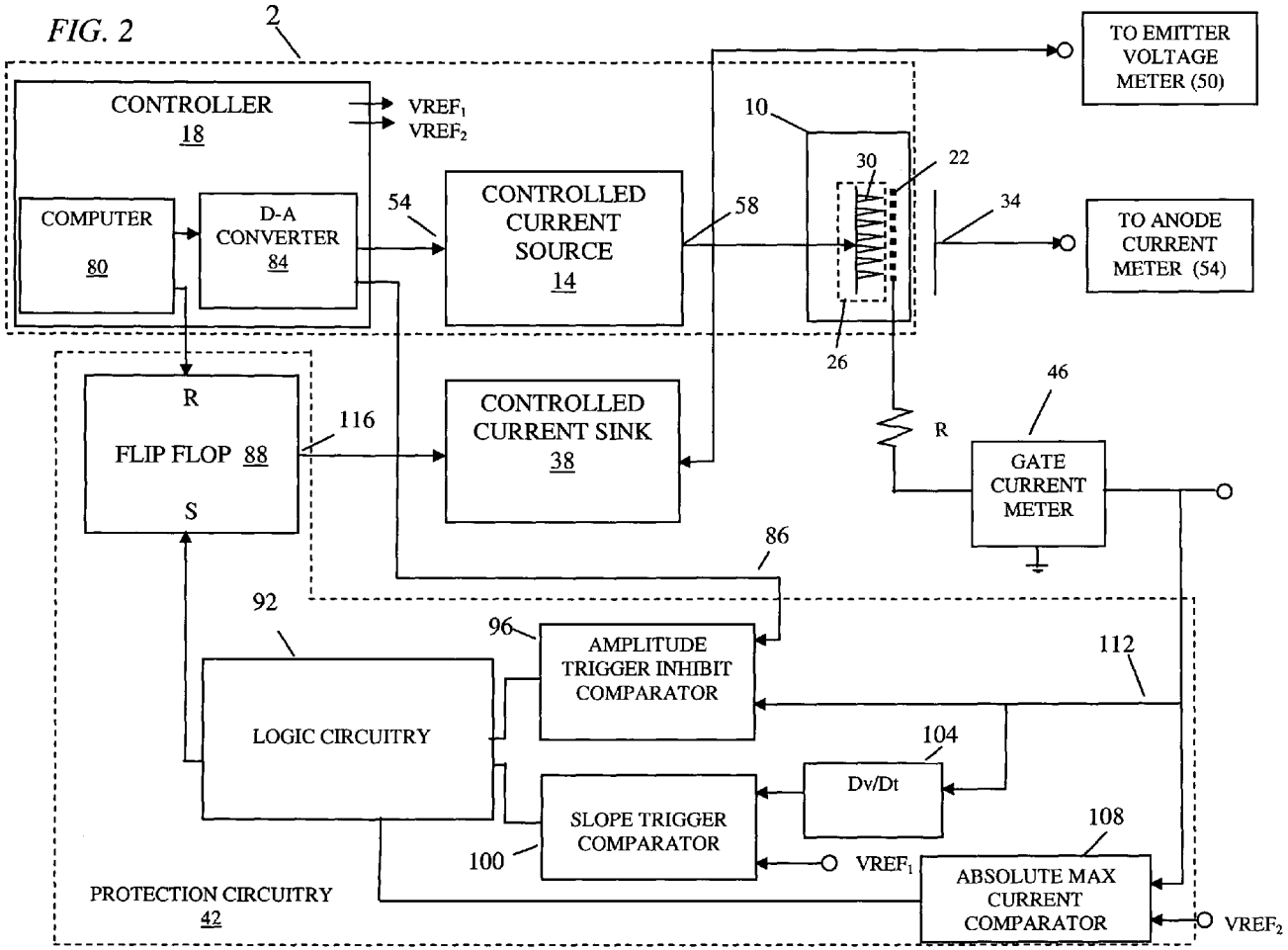
FIG. 2 is a block diagram of one embodiment of the system of FIG. 1, including a current source, a current sink, and protection circuitry.

FIG. 2 shows embodiments of the controller 18 and protection circuitry 42 of the system 2 of FIG. 1. The controller 18 includes a computer 80 in communication with a D-A converter 84. The D-A converter 84 is in communication with the controlled current source 14. The protection circuitry 42 includes an R-S flip-flop 88, logic circuitry 92, an amplitude trigger inhibit comparator 96, a slope trigger comparator 100, a differentiator 104, and an absolute maximum current comparator 108.

The R-S flip-flop 88 includes an R-input terminal, an S-input terminal, and an output terminal 116. The R-input terminal is in communication with the computer 80 of the controller 18, the S-input terminal is connected to an output terminal of the logic circuitry 92, and the output terminal 116 is connected to the controlled current sink 38. Other types of flip-flops can be used without departing from the principles of the invention. In one embodiment, the flip-flop 88 produces a logic low output when the R-input terminal transitions to a high logic state and a logic high output on the output terminal 116 when the S-input terminal transitions to a high logic state (provided the R-input has returned to a low logic state).

In one embodiment, the logic circuitry 92 includes a plurality of input terminals and an output terminal (i.e., the output terminal connected to the S-input terminal described above). The input terminals are connected to an output terminal of the amplitude trigger inhibit comparator 96, of the slope trigger comparator 100, and of the absolute maximum current comparator 108. Various implementations of logic can be used without departing from the principles of the invention.

The differentiator 104 includes an input terminal connected to the gate current meter 46 of the charge-emission device 10 by signal line 112 and an output terminal connected to the slope trigger comparator 100. The gate current meter 46 provides a voltage calibrated to the current measured on the gate electrode 22. An output voltage produced by the differentiator 104 on the output terminal reflects the rate of change of the voltage received on the input terminal.

The slope trigger comparator 100 includes a plurality of input terminals and an output terminal (i.e., connected to the logic circuitry 92 described above). One input terminal is connected to an output terminal of the differentiator 104 and a second input terminal is connected to the controller 18 for receiving a computer-controlled reference voltage ($VREF_1$). The slope trigger comparator 100 produces a logic high signal on its output terminal when the voltage received from the differentiator 104 exceeds the reference voltage. The function of the slope trigger comparator 100 is to identify when the rate of change, as determined by the differentiator 104, indicates undesirable emitter behavior (e.g., "runaway" or bursty charge emission).

The amplitude trigger inhibit comparator 96 includes a plurality of input terminals and an output terminal (i.e., connected to the logic circuitry 92 described above). One input terminal is connected to an output terminal of the D-A converter 84 of the controller 18 by signal line 86 for receiving a computer-controlled reference voltage. A second input terminal is connected to the gate current meter 46 by signal line 112 for receiving the voltage calibrated to the measured gate current. The amplitude trigger inhibit comparator 86 asserts a logic high signal on the output terminal when the voltage received on the second input is less than the reference voltage received from the D-A converter 84 on the first input terminal. Thus, while the voltage corresponding to the specified gate current is less than this reference voltage, the amplitude trigger inhibit comparator 96 inhibits a possible "setting" of the R-S flip-flop 88 by the slope trigger comparator 100 based on the rate of change of the gate voltage. This blocks the slope trigger comparator 100 from causing activation of the current sink 38 when the charge-emission device 10 first starts to emit charge. Otherwise the initial emission of charge could produce a rate of change that exceeds the voltage reference $VREF_1$ and prematurely turns off the charge-emission device 10.

The absolute maximum current comparator 108 includes a plurality of input terminals and an output terminal (i.e., connected to the logic circuitry 92 described above). One input terminal is connected to the controller 18 for receiving a computer-controlled voltage reference. A second input terminal is connected to the gate current meter 46 by signal line 112 for receiving a voltage calibrated to the gate current. The absolute maximum current comparator 108 asserts a logic high signal on its output terminal when the voltage received on its second input terminal is greater than the reference voltage received from the D-A converter 84 on its first input terminal. The absolute maximum current comparator 108 thus places an upper limit on the amount of current that the gate electrode 22 of the charge-emission device 10 is allowed to collect.

Figure 3:
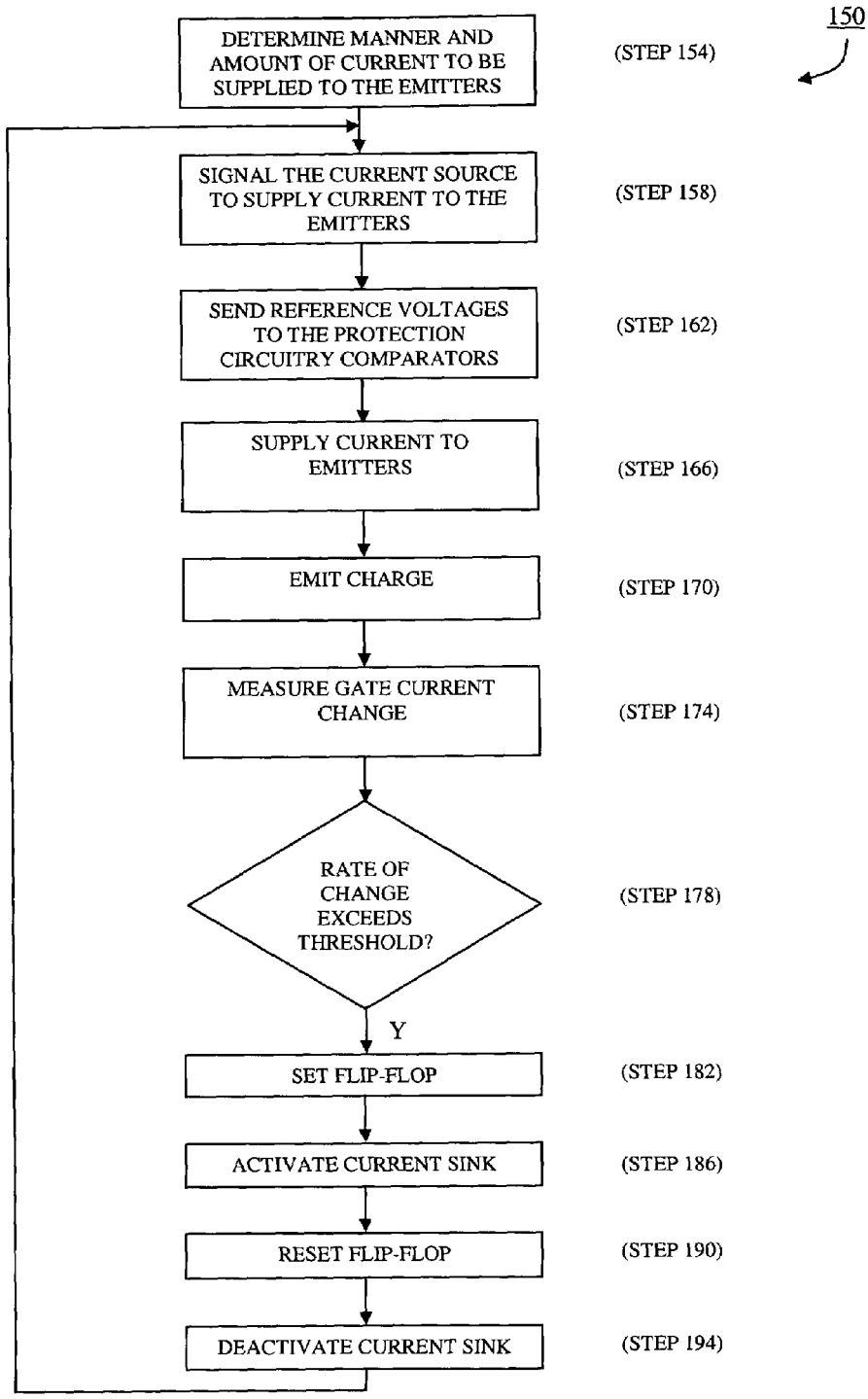
FIG. 3 is a flow diagram of an embodiment of a process for controlling the charge emitted by the micro-fabricated charge emission device.

FIG. 3 shows an embodiment of an automated process 150 that uses the system 2 of FIG. 2 to condition the tips of the emitters 30 in preparation for in an application. Conditioning "cleans" the emitter tips of contamination caused by atmospheric gases or others substances that may have coated the tip and affected its emission characteristics. In general, the process 150 "burns" contaminants off the emitter tips in a controlled fashion that avoids damaging the emitters 30. In the description of the process 150, reference is made to graphs shown in FIG. 4A, FIG. 4B, and FIG. 4C.

Initially, the R-S flip-flop 88 is reset and the current sink 38 deactivated (i.e., not shunting current to ground). At step 154, the computer 80 sends signals to the D-A converter 84 that direct the manner and amount of current to be supplied to the emitters 30 by the current source 14. In one embodiment, the computer 80 determines that the current is to increase linearly as a function of time. The D-A converter 84 sends (step 158) an analog equivalent of the received signals to the input terminal 54 of the current source 14. The D-A converter 84 also sends (step 162) predetermined reference voltages to each of the comparators 96, 100, and 108.

Figures 4A, 4B, 4C:
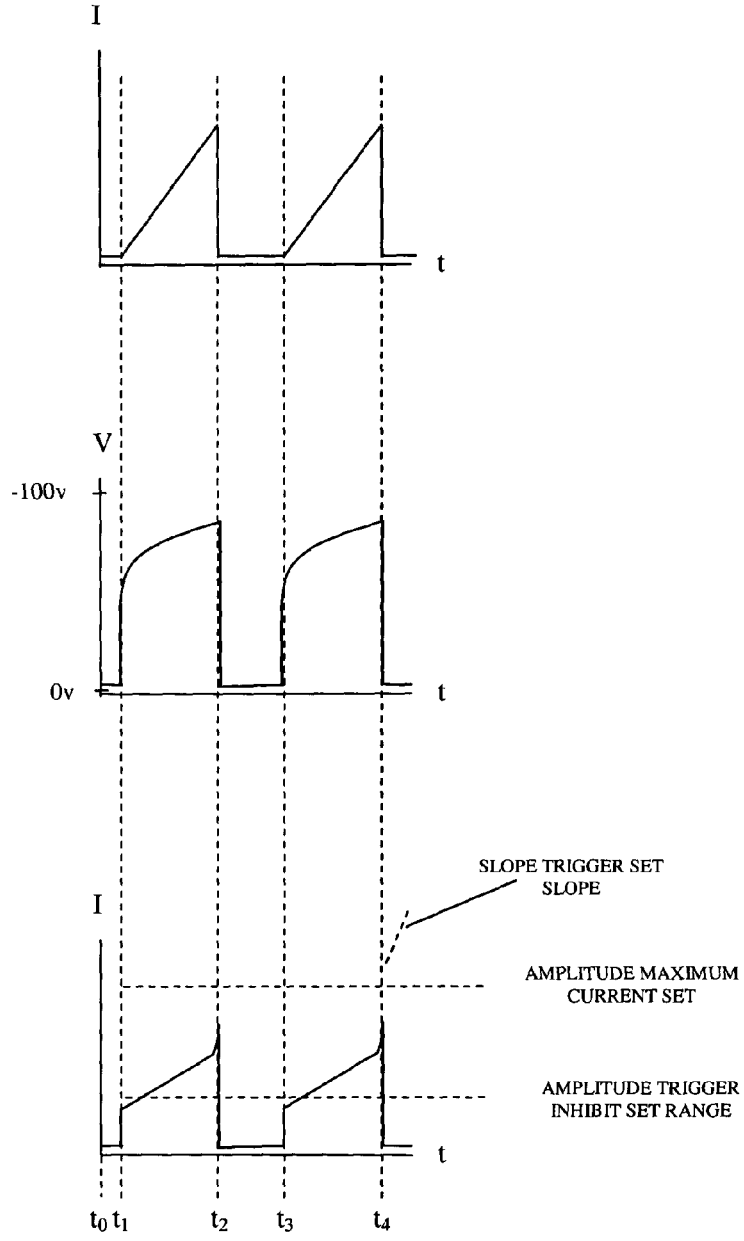
FIG. 4A is a graph of the current supplied to the emitter of the micro-fabricated charge emission device by the current source.
FIG. 4B is a graph of the potential difference formed between the gate electrode and emitters of the micro-fabricated charge emission device resulting from the current supplied to the emitters by the current source as shown in FIG. 4A.
FIG. 4C is a graph of the current flowing through the gate electrode as a result, in part, of the potential difference between the gate electrode and the emitters that induces the emitters to emit charge.

The current source 14 supplies (step 166) current to the emitter array 26 in accordance with the signals received from the D-A converter 84. An example waveform of the emitter current starting at a time to is shown in FIG. 4A. The supply of current to the emitters 30 causes an increase in potential difference between the emitters 30 and the gate electrode 22. FIG. 4B shows the voltage at the emitters 30 with respect to the gate electrode 22 corresponding to the increase in the emitter current as shown in FIG. 4A. This voltage is shown in FIG. 4B to begin increasing at time $t_1$. The emitters 30 in the array 26 begin to emit charge (step 170) when the potential difference between each emitter 30 and the gate electrode 22 reach a certain threshold. This threshold can be different for different emitters 30 in the array 26.

While the current supplied by the current source 14 linearly increases, the emitters 30 produce a corresponding increase in emitted charge and, correspondingly, an increase in the amount of gate current. FIG. 4C shows the current at the gate electrode 22 corresponding to the emitted current as shown in FIG. 4A. The gate current meter 46 produces a voltage calibrated to the measured gate current to the comparators 96, 108 and to the differentiator 104. The differentiator 104 measures (step 174) the change (i.e., slope) in this calibrated voltage and the slope trigger comparator 100 determines (step 178) if this change exceeds a threshold (as determined by the reference voltage ($VREF_1$) sent to the slope trigger comparator 100). Generally, the gate current changes rapidly when a contaminant is burned off at the emitter tips as part of the conditioning process.

When the voltage rate change exceeds the slope trigger threshold, the logic circuitry 92 sets (step 182) the R-S flip-flop 88, provided the other logic conditions are satisfied, such as the voltage calibrated to the gate current exceeds a minimum threshold required by the amplitude trigger inhibit comparator 96. In response to the set signal, the R-S flip-flop 88 sends a signal that activates (step 186) the current sink 38. This event is shown in FIG. 4A to occur at time $t_2$. Activation of the current sink 38 shunts the current produced by the current source 14 to ground (thus preventing the current from passing to the emitters 30).

The emitter current remains at substantially zero until the computer 80 of the controller 18 sends (step 190) a reset signal to the R-S flip-flop 88 of the protection circuitry 42. This event is shown in FIG. 4A to occur at time $t_3$. In response to the reset signal, the R-S flip-flop 88 produces (step 194) a signal that deactivates the current sink 38, and the current supplied by the current source 14 passes to the emitters 30. Accordingly, charge emission resumes until the current sink 38 is once again activated at time $t_4$ because the gate current increased at a rate that exceeds the slope trigger threshold. Eventually, the charge emission stabilizes because the contaminants are burned off the emitters and, consequently, the on-and-off cycles of the charge-emission device 10 come to an end.

While the invention has been shown and described with reference to specific preferred embodiments, it should be understood by those skilled in the art that various changes in form and detail may be made therein without departing from the spirit and scope of the invention as defined by the following claims.

What is claimed is:

1. A system comprising:

a charge-emission device having an emitter;

a controllable current source electrically connected to the emitter of the charge-emission device by an electrical path, the controllable current source supplying to the emitter of the charge-emission device over the electrical path a controlled amount of electrical current that produces a potential difference at the emitter with respect to an electrode to induce the emitter to emit electrical charge; and a current sink connected to the controllable current source for shunting at least a portion of the electrical current to ground upon a detection of a particular charge emission condition.

2. The system of claim 1, further comprising protection circuitry for detecting the particular charge emission condition and for activating the current sink upon the detection.

3. The system of claim 1, wherein the particular charge emission condition is indicative of an excessive flow of current from the emitter.

4. The system of claim 1, wherein the particular charge emission condition is indicative of an excessive rate of change of the current flowing from the emitter.

5. The system of claim 1, wherein the current source is adjustable to enable changes to an amount of electrical current being supplied by the controllable current source to the emitter.

6. The system of claim 1, further comprising a controller directing the controllable current source to provide a predetermined amount of electrical current.

7. The system of claim 1, wherein the charge-emission device is a device that emits ions.

8. The system of claim 7, wherein the emitted ions have a positive charge.

9. The system of claim 1, wherein the charge-emission device is a device that emits electrons.

10. The system of claim 1, wherein the charge-emission device emits fluid.

11. The system of claim 1, wherein the charge-emission device is a gated device.

12. The system of claim 1, wherein the charge-emission device has an array of emitters including the emitter and a second emitter, and the controllable current source provides current to each emitter in the emitter array.

13. The system of claim 1, wherein the controllable current source is a first current source, the charge-emission device has an array of emitters including a first emitter and a second emitter, and further comprising a second controllable current source, the first current source supplying a first controlled amount of electrical current to the first emitter and the second current source supplying a second controlled amount of current to the second emitter.

14. A system comprising:

a micro-fabricated charge-emission device having an emitter;

controllable means for supplying to the emitter of the charge-emission device a controlled amount of electrical current that produces a potential difference at the emitter with respect to an electrode to induce the emitter to emit electrical charge; and means, electrically connected to an electrical path between the supplying means and the emitter, for shunting at least a portion of the supplied electrical current to ground upon a detection of a particular charge emission condition.

15. The system of claim 14, further comprising means for signaling the supplying means to supply the controlled amount of electrical current.

16. The system of claim 14, further comprising means for adjusting the controlled amount of electrical current supplied to the emitter.

17. The system of claim 14, further comprising means for detecting a particular charge emission condition.

18. A method of controlling an amount of charge emitted by a charge-emission device, the method comprising:

supplying a controlled amount of current from a controllable current source to an emitter of a charge-emission device over an electrical path;

emitting charge from the emitter of the charge-emission device in response to the current received from the controllable current source; and shunting the current supplied by the controlled current source to ground upon a detection of a particular charge emission condition.

19. The method of claim 18, further comprising adjusting the amount of electrical current supplied to the emitter by the controlled current source.

20. The method of claim 18, wherein shunting the supplied current includes detecting an excessive rate of change in an amount of charge being emitted by the emitter.

21. The method of claim 18, wherein shunting the supplied electrical current includes detecting an excessive amount of charge being emitted by the emitter.

22. A system comprising:

a charge-emission device having an emitter and a gate electrode; and a controllable current source electrically connected to the emitter of the charge-emission device by an electrical path over which the controllable current source supplies a controlled amount of electrical current to the emitter, the supplied amount of electrical current producing a voltage difference between the emitter and the gate electrode of a magnitude sufficient to cause the emitter to emit electrical charge without having to use a voltage supply to apply a voltage bias to the gate electrode in order to achieve the voltage difference that causes emission of the electrical charge.

23. The system of claim 22, wherein the charge-emission device is micro-fabricated and the gate electrode is integrated with the emitter in a micro-fabricated structure.

24. The system of claim 22, further comprising means for signaling the current source to supply the controlled amount of electrical current.

25. The system of claim 22, further comprising means for adjusting the controlled amount of electrical current supplied to the emitter.

26. The system of claim 22, further comprising a current sink connected to the controllable current source for shunting at least a portion of the electrical current to ground upon a detection of a particular charge emission condition.

27. The system of claim 26, further comprising protection circuitry for detecting the particular charge emission condition and for activating the current sink upon the detection.

28. The system of claim 26, wherein the particular charge emission condition is indicative of an excessive flow of current from the emitter.

29. The system of claim 22, wherein the charge-emission device has an array of emitters including the emitter and a second emitter, and the controllable current source provides current to each emitter in the emitter array.

30. The system of claim 22, wherein the controllable current source is a first current source, the charge-emission device has an array of emitters including a first emitter and a second emitter, and further comprising a second controllable current source, the first current source supplying a first controlled amount of electrical current to the first emitter and the second current source supplying a second controlled amount of current to the second emitter.

31. A method of controlling an amount of charge emitted by a charge-emission device having an emitter and a gate electrode, the method comprising:

supplying a controlled amount of current from a controllable current source to the emitter of the charge-emission device over an electrical path; and producing, by the controlled amount of current, a voltage difference between the emitter and the gate electrode of a magnitude sufficient to cause the emitter to emit electrical charge without having to use a voltage supply to apply a voltage bias to the gate electrode in order to achieve the voltage difference that causes emission of the electrical charge.

32. The method of claim 31, further comprising adjusting the amount of electrical current supplied to the emitter by the controlled current source.

33. The method of claim 31, further comprising shunting the current supplied by the controlled current source to ground upon a detection of a particular charge emission condition.

34. The method of claim 33, wherein shunting the supplied current includes detecting an excessive rate of change in an amount of charge being emitted by the emitter.

35. The method of claim 33, wherein shunting the supplied electrical current includes detecting an excessive amount of charge being emitted by the emitter.

* * * * *